US009362067B2

(12) United States Patent
Rösch et al.

(10) Patent No.: US 9,362,067 B2
(45) Date of Patent: Jun. 7, 2016

(54) CONTACT SLIDER UNIT FOR A SWITCHING UNIT, IN PARTICULAR FOR A CIRCUIT BREAKER

(75) Inventors: Bernhard Rösch, Sulzbach-Rosenberg (DE); Alfred Schnellinger, Kuemmersbruck (DE); Alexander Spies, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 46 days.

(21) Appl. No.: 14/347,710

(22) PCT Filed: Mar. 21, 2012

(86) PCT No.: PCT/EP2012/054971

§ 371 (c)(1), (2), (4) Date: Mar. 27, 2014

(87) PCT Pub. No.: WO2013/139386

PCT Pub. Date: Sep. 26, 2013

(65) Prior Publication Data

US 2014/0231235 A1 Aug. 21, 2014

(51) Int. Cl.

| | |
|---|---|
| ***H01H 1/18*** | (2006.01) |
| ***H01H 1/20*** | (2006.01) |
| ***H01H 15/06*** | (2006.01) |
| *H01H 11/00* | (2006.01) |
| *H01H 71/24* | (2006.01) |

(52) U.S. Cl.

CPC ..... *H01H 15/06* (2013.01); *H01H 1/20* (2013.01); *H01H 11/00* (2013.01); *H01H 71/2463* (2013.01)

(58) Field of Classification Search

CPC ... H01H 11/0012; H01H 1/20; H01H 50/546; H01H 1/2008; H01H 1/18

USPC ..... 200/243; 335/281, 129

See application file for complete search history.

(56) References Cited

U.S. PATENT DOCUMENTS

| | | | | |
|---|---|---|---|---|
| 2,783,340 | A * | 2/1957 | Davies et al. | 200/243 |
| 2,985,736 | A | 5/1961 | Coker | |
| 6,198,058 | B1 | 3/2001 | Graninger et al. | |
| 2011/0120844 | A1 | 5/2011 | Hoffmann et al. | |

FOREIGN PATENT DOCUMENTS

| | | | |
|---|---|---|---|
| CN | 200953287 | Y | 9/2007 |
| CN | 101322208 | A | 12/2008 |
| CN | 102074387 | A | 5/2011 |
| DE | 1154553 | B | 9/1963 |
| DE | 19549179 | A1 | 7/1997 |

(Continued)

OTHER PUBLICATIONS

International Search Report PCT/ISA/210 for International Application No. PCT/EP2012/054971 Dated on Mar. 21, 2012.

(Continued)

*Primary Examiner* — Renee Luebke
*Assistant Examiner* — Ahmed Saeed
(74) *Attorney, Agent, or Firm* — Harness, Dickey & Pierce, P.L.C.

(57) ABSTRACT

A contact slider unit is disclosed for a switching unit, in particular for a circuit breaker, having a contact slider and a contact piece. In an embodiment, the contact piece has a passage through which a tappet is guided.

12 Claims, 1 Drawing Sheet

(56) References Cited

FOREIGN PATENT DOCUMENTS

| | | | |
|---|---|---|---|
| DE | 102007015793 | A1 | 10/2008 |
| FR | 1160431 | A | 7/1958 |
| FR | 2435793 | A1 | 4/1980 |
| FR | 2895143 | A1 | 6/2007 |

OTHER PUBLICATIONS

International Written Opinion PCT/ISA/237 for International Application No. PCT/EP2012/054971 Dated on Mar. 21, 2012.

Office Action for Co-Pending U.S. Appl. No. 14/347,714 issued on Oct. 20, 2015.

Office Action for Co-Pending U.S. Appl. No. 14/347,714 issued on Jul. 16, 2015.

Office Action for Chinese Patent Application No. 201280058934X issued on Jul. 15, 2015 with English language translation.

Office Action for Chinese Patent Application No. 201280059688X issued on Jul. 31, 2015 with English language translation which corresponds to Co-Pending U.S. Appl. No. 14/347,714.

* cited by examiner

CONTACT SLIDER UNIT FOR A SWITCHING UNIT, IN PARTICULAR FOR A CIRCUIT BREAKER

PRIORITY STATEMENT

This application is the national phase under 35 U.S.C. §371 of PCT International Application No. PCT/EP2012/054971 which has an International filing date of Mar. 21, 2012, which designated the United States of America, the entire contents of each of which are hereby incorporated herein by reference.

FIELD

At least one embodiment of the invention generally relates to a contact slide unit for a switching unit, in particular for a circuit breaker, having a contact slide and a switching piece. In addition, at least one embodiment of the invention relates to a switching unit, in particular a circuit breaker, having a contact slide unit comprising a contact slide and a switching piece.

BACKGROUND

Switching units, in particular circuit breakers, are used, inter alia, for safe disconnection in the event of a short circuit and thus protect consumers and installations. In addition, electrical or mechanical switching units are suitable for the operationally dependent, manual switching of consumers and for the safe isolation of an installation from the electrical grid in the event of maintenance work or changes to the installation. Electrical switching units are often operated electromagnetically.

That is to say that such switching units or circuit breakers are electrical switching devices which are high quality in technical terms with integrated protection for motors, lines, transformers and generators. They are used at service facilities with a low switching frequency. Such switching units are also suitable for overload protection, in addition to short-circuit protection.

In the event of a short circuit, an electrical switching unit or a circuit breaker disconnects an electrical installation safely. Thus, this electrical switching unit provides safety protection from overload. Any conductor through which the current is flowing is heated to a greater or lesser extent. The heating is in this case dependent on the ratio of the current intensity to the conductor cross section, the so-called current density.

The current density should not become too great since, otherwise, the conductor insulation can be scorched by excessive heating and possibly a fire can be triggered. In order to protect electrical installations from these damaging effects, switching units or circuit breakers are used as overcurrent protection devices.

Circuit breakers have two tripping mechanisms which act independently of one another for the overload and short-circuit protection. Both releases are connected in series. An electromagnetic release which acts virtually without any delay in time performs the function of protection in the event of a short circuit. In the event of a short circuit, the electromagnetic release unlatches a switching mechanism of the circuit breaker without any delay. A switching armature isolates the switching piece before the short-circuit current can reach its maximum value.

Known switching units have a contact slide unit comprising a contact slide and a movable switching piece. The movable switching piece also has electrical contacts. In addition, such switching units have fixed contacts to an electrical line.

In a switched-on state, the electrical contacts of the movable switching piece make contact with the fixed contacts of the switching unit or the circuit breaker.

In the event of a short circuit, the electrical contacts of the movable switching piece are removed from the fixed contacts, with the result that the current flow is interrupted. In this process, the movable switching piece is detached from the fixed contacts. Owing to short-circuit disconnections in a switching unit or a circuit breaker, however, after detachment of the movable switching piece, the movable switching piece can be caused to rotate about its longitudinal axis.

If the movable switching piece rotates about its longitudinal axis, this is also referred to as "bridge rotator". That is to say that the movable switching piece then, after rotation, no longer returns to its initial position, but remains in the rotated position.

Known contact slides of switching units often have two guide systems. These include an internal guide system and an external guide system. The external guide system is used when the switching operation, i.e. the switch-on or switch-off operation, takes place via a switching mechanism of the switching unit or the circuit breaker. In this case, no bridge rotator occurs.

The internal guide system is used in the event of a short circuit when the switching operation is performed via a switching armature, often a plunger, of the switching unit or the circuit breaker. That is to say that, in the event of disconnection owing to a short circuit, the movable switching piece along the internal guide system leads the contact slide, rebounds at the stop faces in the so-called lower part of the switching unit or the circuit breaker and flies back along the internal guide system again. In this case, it flies in the opposite direction to the switching armature or the plunger of the switching unit or the circuit breaker. In this case, it may occur that the movable switching piece and the plunger meet one another outside their center lines, with the result that this can lead to a rotation of the movable switching piece about its longitudinal axis.

If the movable switching piece remains in the rotated state, when the switching unit or the circuit breaker is next switched on the contacts, in particular silver contacts of the movable switching piece and the fixed contacts of the switching unit or the circuit breaker, no longer meet one another, with the result that failure phenomena occur. That is to say that a switching piece which remains in a rotated position is disadvantageous since the circuit breaker is then no longer usable. A non-functioning switching piece and a non-functioning switching unit are disadvantageous for the electrical consumers and the installation in which the switching unit or the circuit breaker is installed.

SUMMARY

At least one embodiment of the present invention resides in providing a contact slide unit for a switching unit, in particular for a circuit breaker, which is designed in such a way that bridge rotators of the switching piece are avoided.

In at least one embodiment of the invention, a contact slide unit for a switching unit is provided, in particular for a circuit breaker. Further example embodiments of the invention result from the dependent claims, the description and the drawings. Features and details which are described in connection with the contact slide unit in this case also apply in connection with the switching unit, in particular the circuit breaker, and vice versa.

Switching units, in accordance with embodiments of the invention can be electrical switching units, in particular electromagnetically operated switching units or switches, but can also be mechanical switching units. The electrical switching units include in particular circuit breakers.

In accordance with an embodiment of the invention, a contact slide is disclosed for a switching unit, in particular for a circuit breaker, which has a contact slide and a switching piece. In embodiment of the invention, the switching piece has an aperture, through which a plunger is guided. The switching piece or the switching bridge is thus guided by the extended plunger. The aperture in the bridge ensures a vertical guidance during flight of the bridge. As a result, a rotation of the bridge is prevented. Therefore, the plunger is provided with an additional shoulder which enables clean guidance of the switching bridge.

BRIEF DESCRIPTION OF THE DRAWINGS

Further advantages and embodiments of the invention will be explained below with reference to example embodiments and with reference to the drawing, in which, in each case schematically.

DETAILED DESCRIPTION OF THE EXAMPLE EMBODIMENTS

Figure 1:
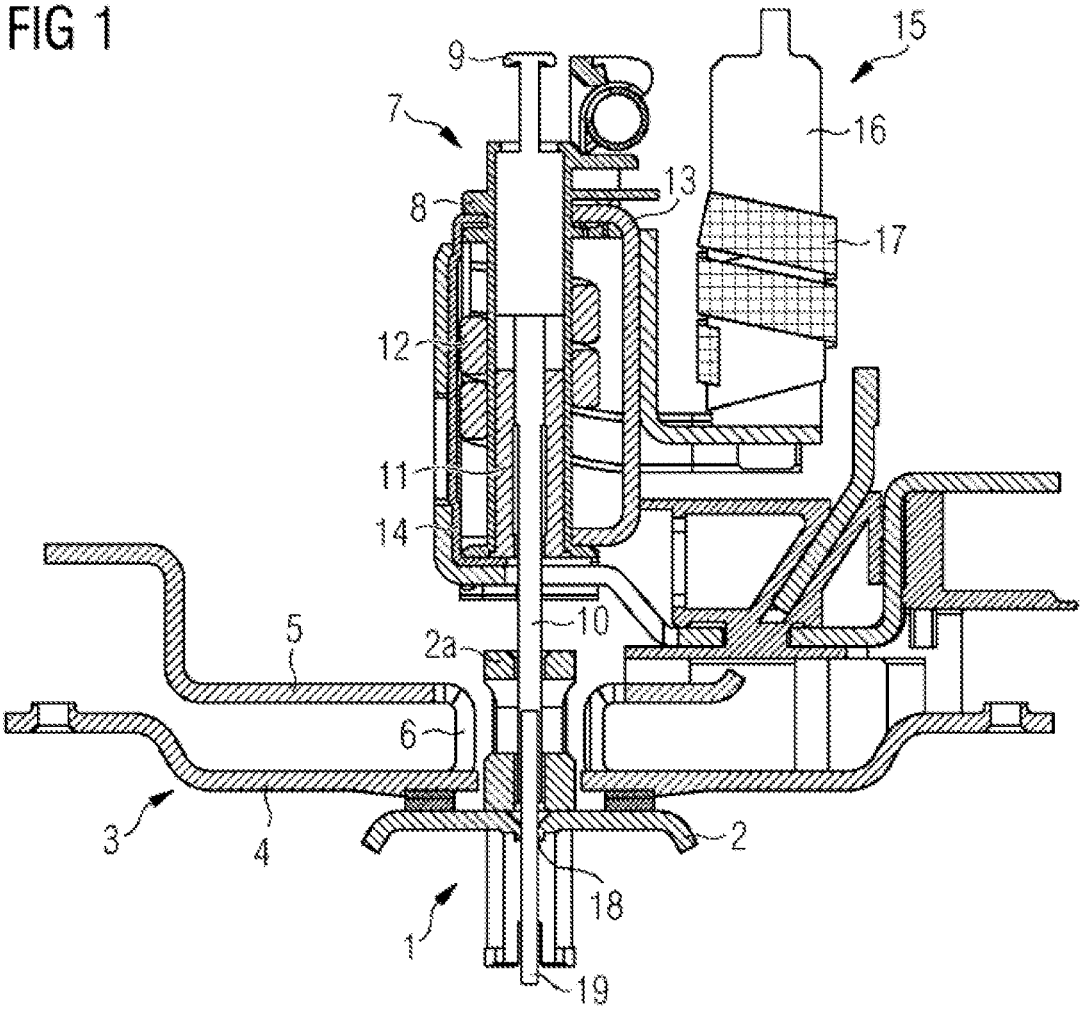
FIG. 1 shows a sectional illustration of a contact slide unit according to the invention comprising fixed switching pieces and overload release.

Switching units, in accordance with embodiments of the invention can be electrical switching units, in particular electromagnetically operated switching units or switches, but can also be mechanical switching units. The electrical switching units include in particular circuit breakers.

In accordance with an embodiment of the invention, a contact slide is disclosed for a switching unit, in particular for a circuit breaker, which has a contact slide and a switching piece. In embodiment of the invention, the switching piece has an aperture, through which a plunger is guided. The switching piece or the switching bridge is thus guided by the extended plunger. The aperture in the bridge ensures a vertical guidance during flight of the bridge. As a result, a rotation of the bridge is prevented. Therefore, the plunger is provided with an additional shoulder which enables clean guidance of the switching bridge.

In terms of manufacturing technology, the novel switching piece according to an embodiment of the invention provides the advantages that only a single aperture needs to be positioned in the bridge and that no further additional part which has an effect inhibiting bridge rotation is required. The bridge is guided clearly by the extended plunger. That is, the risk of jamming and rotation in the contact slide is minimized to a great extent by the aperture. In addition, no additional costs are incurred either since the extension of the plunger only requires the use of a metal core in order to prevent the plunger from breaking off.

In accordance with an embodiment of the invention, in a further embodiment, provision is made for preferably two oppositely arranged horns to be embossed on the switching piece or on the contact bridge, which horns are preferably used for preventing rotation. In addition, guide grooves are led into the contact slide and hold these horns and therefore the bridge in the vertical and horizontal position within permissible rotation limits. The guide grooves are matched to the bridge horns in such a way that the tolerances are suitable for manufacturing and prevent a rotation of the bridge. This rotation is then prevented effectively both about the y axis and about the x axis.

The sliding piece according to an embodiment of the invention is preferably in the form of a web and likewise has a contact at the end. These two contacts enter into a conductive connection with two fixed contacts in the switched-on state of the switching unit, in which the switching piece is integrated. Two preferably mutually opposite projections are arranged in the central region of the preferably web-shaped switching piece and engage in guide grooves in the contact slide. Preferably two mutually opposite bridge horns which are preferably arranged at a 90° angle with respect to the switching piece are positioned on these projections and, during a rotational movement, form touch points with the inner wall of the contact slide, with the result that a further rotation is suppressed by the inner wall. In addition, an aperture is arranged centered in the central region of the switching piece, through which aperture the plunger arranged in the contact slide is guided.

The contact slide unit according to an embodiment of the invention prevents a complete rotation of the contact bridge by way of the aperture in the switching piece, through which an extended plunger is guided. This effect is reinforced by embossed stabilizing elements in the form of bridge horns on the switching piece. In particular, a rotated or upended bridge is prevented by the contact slide unit according to an embodiment of the invention, which would result in the switch becoming unfunctional. In terms of manufacturing technology, the switching piece according to the invention does not require any additional complexity. In addition, the present technical solution is not cost-intensive either since only an additional metal core is required for the plunger to be extended.

FIG. 1 shows a contact slide unit 1 according to an embodiment of the invention comprising a contact slide 2*a* and a movable switching piece 2, which is arranged opposite the fixed switching pieces 3. The fixed switching pieces 3 are preferably U-shaped with two limbs 4, 5, which are connected to one another by a transition region 6. A short-circuiting release 7 is arranged above the contact slide unit 1. The short-circuiting release 7 has a carrier part 8, preferably consisting of plastic, in which an armature 9 with a plunger 10, which is arranged within a pole 11 and protrudes into the contact slide unit 1, is located. A coil 12 is wound around the carrier part 8. The coil 12 is surrounded by a yoke 13 and magnetic sheet metal 14. An overload release 15 which comprises a bimetallic element 16 around which a heating conductor 17 is wound is located next to the short-circuiting release 7.

In accordance with an embodiment of the invention, the switching piece 2 is provided with an aperture 18, through which the plunger 10 is guided. In order to extend the plunger 10, the plunger 10 is provided with a shoulder 19, which is in the form of a metal core.

Figure 2:
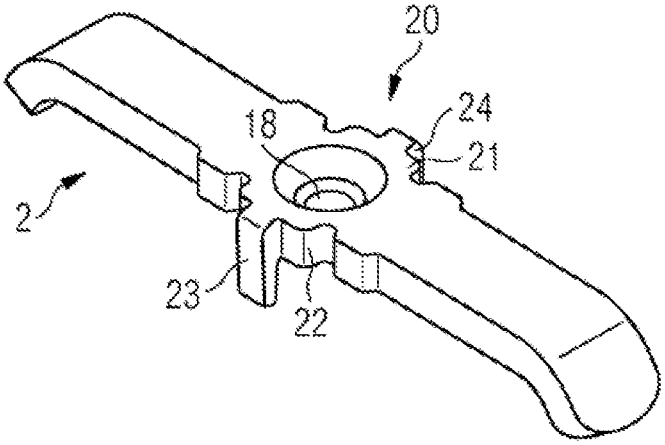
FIG. 2 shows a perspective illustration of a switching piece according to the invention.

FIG. 2 illustrates the switching piece 2 according to an embodiment of the invention. The switching piece 2 according to an embodiment of the invention is preferably web-shaped and has a central region 20, on which mutually opposite projections 21, 22 are arranged. These projections 21, 22 engage in guide grooves in the contact slide 2*a*. Preferably two mutually opposite bridge horns 23, 24 which are arranged at an angle of preferably 90° with respect to the switching piece 2 are positioned on these projections 21, 22 and, in the event of a rotational operation, form touch points with the inner wall of the contact slide 2*a*, with the result that a further rotation is suppressed by the inner wall. In addition, an aperture 18 is arranged centered in the central region 20 of the switching piece 2, through which aperture the plunger 10 arranged in the contact slide 2*a* can be guided.

The contact slide unit according to an embodiment of the invention prevents a complete rotation of the contact bridge by means of the aperture in the switching piece, through which an extended plunger is guided. This effect is reinforced by embossed stabilizing elements of bridge horns on the switching piece. In particular, a rotated or upended bridge which would result in the switch becoming unfunctional is prevented by the contact slide unit according to the invention. In respect of manufacturing technology, the switching piece according to the invention does not require any additional complexity since only one aperture needs to be positioned in the switching piece. In addition, the present technical solution is also not cost-intensive since only an additional metal core is required for the plunger to be extended.

The invention claimed is:

1. A contact slide unit for a switching unit, comprising:

a contact slide having opposing side surfaces;

a plunger between the opposing side surfaces of the contact slide; and a switching piece in sliding contact with the opposing side surfaces, the switching piece including an aperture through which the plunger is guidable, wherein the switching piece includes embossed bridge horns engaged in guide grooves in the opposing side surfaces of the contact slide, and wherein the bridge horns have a length in a switching direction of the switching piece that is greater than a thickness of the switching piece.

2. The contact slide unit of claim 1, wherein the plunger is extended by a shoulder.

3. The contact slide unit of claim 2, wherein the shoulder is a metal core.

4. A switching unit, comprising:

the contact slide unit of claim 1.

5. The contact slide unit of claim 1, wherein the contact slide unit is for a circuit breaker.

6. A switching unit, comprising:

the contact slide unit of claim 2.

7. A circuit breaker, comprising:

the contact slide unit of claim 1.

8. A circuit breaker, comprising:

the contact slide unit of claim 2.

9. The contact slide unit of claim 1, wherein the bridge horns extend from projections in a central region of the switching piece.

10. The contact slide unit of claim 1, wherein the bridge horns extend in a direction parallel to a switching direction of the switching piece.

11. The contact slide unit of claim 1, wherein the aperture is formed by tapered side walls of the switching piece.

12. The contact slide unit of claim 1, wherein the aperture has a frustoconical shape.

* * * * *